United States Patent [19]

Elias et al.

[11] 4,009,784

[45] Mar. 1, 1977

[54] DOCUMENT HANGING APPARATUS

[76] Inventors: Abram G. Elias, 1527 Greg St., Sparks, Nev. 89431; Peter G. Elias, 6 Wedgewood Drive, Winnipeg, Manitoba, Canada, R3T2J8

[22] Filed: Oct. 8, 1975

[21] Appl. No.: 620,569

Related U.S. Application Data

[63] Continuation-in-part of Ser. No. 514,890, Oct. 15, 1974, Pat. No. 3,923,353.

[52] U.S. Cl. ..... 211/46; 211/113; 211/126; 24/67 AR; 312/184

[51] Int. Cl.[2] ..... A47B 63/00; B42F 15/00

[58] Field of Search ..... 24/67 R, 67 AR; 211/46, 211/113, 126, 184; 312/184

[56] References Cited

UNITED STATES PATENTS

| | | | |
|---|---|---|---|
| 2,969,793 | 1/1961 | Furrer | 211/126 |
| 3,215,385 | 11/1965 | Rockland | 211/113 |
| 3,923,353 | 12/1975 | Elias et al. | 312/184 |

FOREIGN PATENTS OR APPLICATIONS

| | | | |
|---|---|---|---|
| 1,219,080 | 5/1959 | France | 312/184 |
| 158,898 | 9/1954 | Sweden | 312/184 |

*Primary Examiner*—Casmir A. Nunberg
*Attorney, Agent, or Firm*—Boone, Schatzel, Hamrick & Knudsen

[57] ABSTRACT

Document hanging apparatus comprising an elongated strip of plastic material folded along a longitudinal foldline and having apertures provided in the side portions near the foldline, and adhesive document affixing means provided along one edge opposite the fold to engage a document and secure such document between the sides of the strip.

15 Claims, 12 Drawing Figures

DOCUMENT HANGING APPARATUS

CROSS REFERENCE TO RELATED APPLICATION

This application is a continuation-in-part of our copending application for a document hanger, Ser. No. 514,890, filed Oct. 15, 1974 now U.S. Pat. No. 3,923,353.

BACKGROUND OF THE INVENTION

1. FIELD OF THE INVENTION

The present invention relates generally to document storage apparatus, and more particularly, to a document hanging apparatus by means of which documents may be suspended from rails or the like without the need for mechanical clips, bolts, etc.

2. DESCRIPTION OF THE PRIOR ART

Heretofore, document hangers or long filing devices have typically been provided in the form of hanging structures such as those disclosed in the U.S. Pat. Nos. to Pedersen 1,878,177, Pedersen 1,832,239, Kohler 3,704,051, Snider et al 3,069,737, Snider et al 2,869,210, Morcheles et al 3,221,892, Fletcher 3,364,528 and Elias et al 3,580,488, and our pending applications, Ser. Nos. 374,007 and 514,890. Other related structures are disclosed in the U.S. Pat. Nos. to Kirkorian 3,684,340, Furrer 2,969,793, and Swan 818,130, and the Swiss Pat. No. to Neher 349,954. Although such apparatus has found wide use in the field, many suffer from the disadvantage of mechanical complexity, bulkiness of structure or lack of strength. Whereas mechanical complexity usually causes the unit price of the device to be inordinantly high, stuctural bulkiness causes the hanger to occupy a large proportion of the available hanging space which could otherwise be occupied by documents themselves. This, of course, limits the quantity of documents that can be stored in any particular closet or cabinet.

SUMMARY OF THE PRESENT INVENTION

It is therefore an object of the present invention to provide a novel document hanger which is compact, simple in construction, inexpensive to make, easy to affix to the documents to be supported and easily removable and replaceable in the storage means.

Another object is to provide a versatile document hanger suitable for use with several different storage means.

Briefly, a preferred embodiment of the present invention includes an elongated strip of plastic material folded along a longitudinal foldline and having hanging apertures of a particular type of configuration positioned at a particular distance from each other and provided in the portion nearest the fold. A strip of tape, adhesively coated on both sides, runs along at least one of the edges opposite the fold for securing a document placed between the folded edges to the hanger.

Among the advantages off the present invention are that it can be made using very simple processes, available materials and with a minimum of labor.

Another advantage of the present invention is that it can be made in a long strip form so that individual hangers of any desirable length may be cut therefrom.

Still another advantage of the present invention is that it can be very easily fastened to a document without the use of any tools, clips, or pins.

Still another advantage is that due to the unique design of the hanging aperture, the hanger can be removed from one rail without disturbing the other end, thus, making documents conveniently removable and replaceable in the storage means.

Yet another advantage of the present invention is that when applied to a single sheet document, it may be passed through a duplicating machine along with the document and need not be removed therefrom.

These and other advantages of the present invention will become apparent to those of ordinary skill in the art after having read the following detailed description of the preferred embodiment which is illustrated in the several figures of the drawing.

IN THE DRAWING

DETAILED DESCRIPTION OF THE PREFERRED EMBODIMENT

Figure 1:
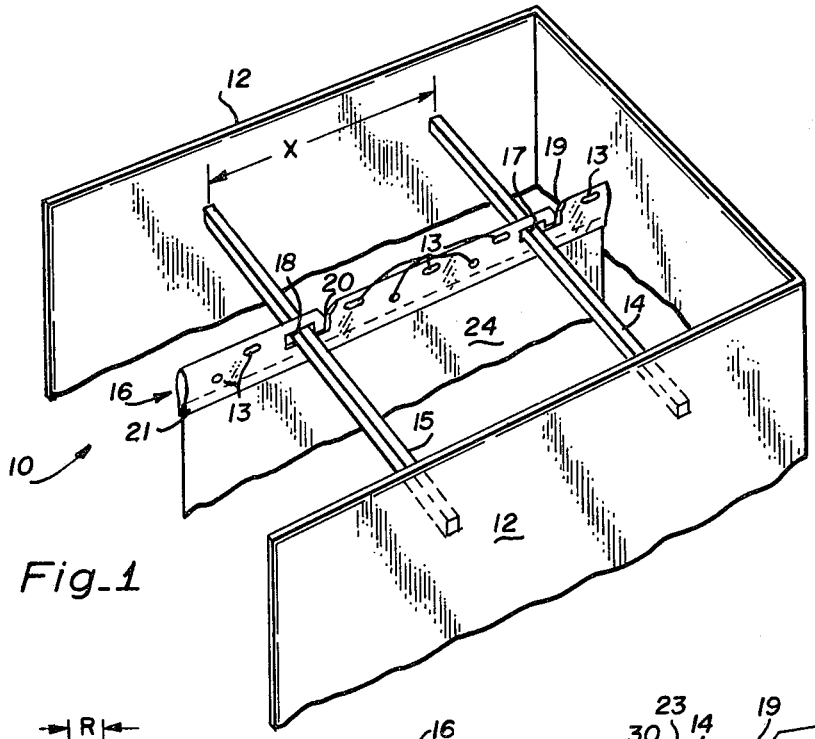
FIG. 1 is a perspective view illustrating a document filing means in accordance with the present invention.

Referring to FIG. 1 of the drawing, a document filing apparatus 10 is illustrated. The apparatus includes a protective storage means 12 having two rods 14 and 15 fixedly attached to the inside thereof, a document hanger 16 connected with rods 14 and 15, and document 24 adhesively attached to document hanger 16 by adhesive strip 21. Document hanger 16 is comprised of an enlongated strip of plastic or similar material folded along the centerline of its length to form two strip sides **16*a* and 16*b***.

The strip side **16*a* is provided with elongated apertures 17*a* and 18*a*, and slits 19*a* and 20*a*** which, along with the fold *f* form L-shaped projections 23 terminating in tabs **22*a* and 25*a*, respectively. Similarly, the strip side 16*b* is provided with elongated apertures 17*b* and 18*b*, slits 19*b* and 20*b*, and L-shaped projections 23 terminating in tabs 22*b* and 25*b***, respectively. The letters *a* and *b* designate corresponding components of each strip side. Slits 19 and 20 run parallel to the fold for a short distance from the bottom of elongated apertures 17 and 18, and then perpendicular to the fold to a V-shaped notch cut in the top of hanger 16 along its fold. The lower edges of L-shaped members 23 form rail-bearing edges 30*a* and 30*b*, and 31*a* and 31*b*.

An adhesive means is disposed to run along the length of the hanger 16 on the inside surface of at least one of the strip sides proximate the strip side edge opposite the fold.

Figure 2:
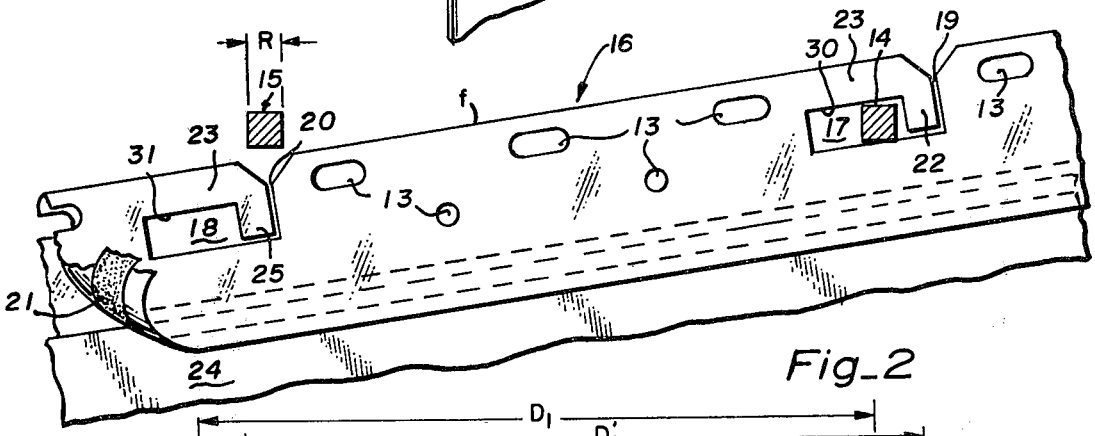
FIG. 2 is a partially cut-away side view, illustrating the method of attaching the document hanger to the supporting rails and the method of attaching the document to the document hanger.
Figure 3:
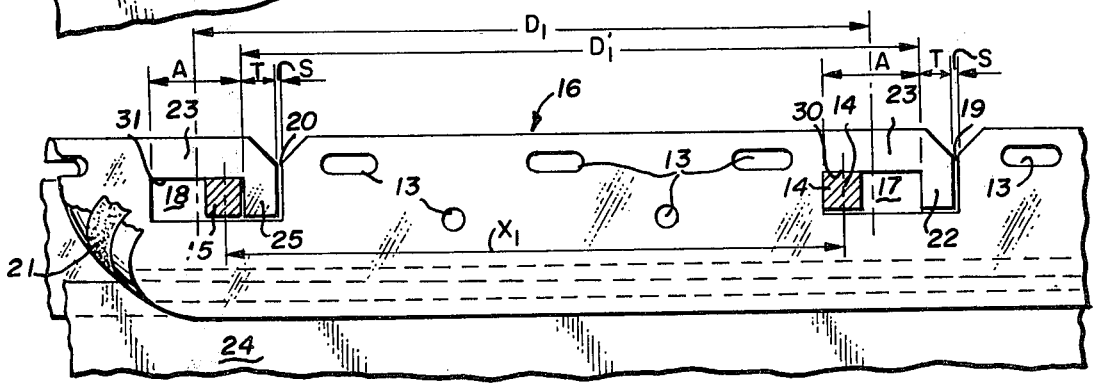
FIG. 3 is a side view illustrating the position of the rails relative to the document hanger when the document hanger is attached to both rails.

Referring now to FIGS. 2 and 3, document hanger 16 is shown having one end disposed in engagement with rail 14 (FIG. 2) and suspended from both rails 14 and 15 (FIG. 3). As illustrated, document 24 is adhesively attached to hanger 16 by placing it midway along adhesive surface 21 and folding the sides of hanger 16 thereover. Document 24 is thus affixed to the hanger by part of adhesive strip 21 and the two sides of hanger 16 are held together by the rest of adhesive strip 21.

Connection of hanger 16 to the rails 14 and 15 is effectuated by placing slit 19 proximate rail 14 and forcing it upward with a slight lateral motion to deflect tab 22 and allow rail 14 to enter aperture 17. Hanger 16 is moved forward into the position shown in FIG. 2 allowing tabs 22 to return to their normal position closing apertures 17. Apertures 18 are connected with rail 15 in like manner by forcing tabs 25 up, around and over rail 15 by an upward, twisting, pushing movement until tabs 25 return to their normal position closing apertures 18. The reverse procedure may be taken to remove a hanger from the rails.

Figure 4:
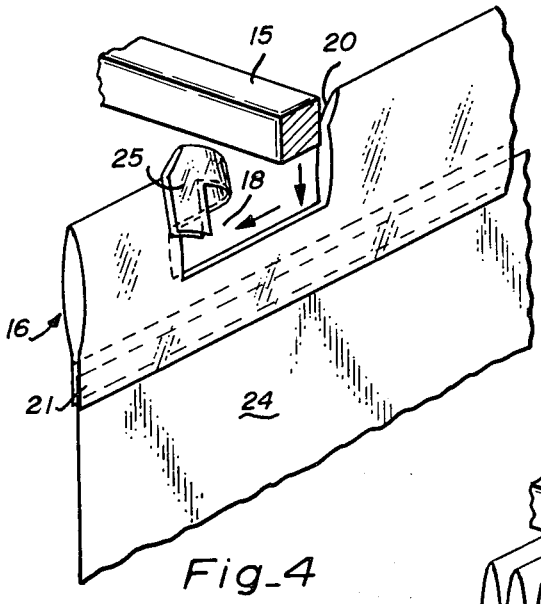
FIG. 4 is a perspective view illustrating the functioning of the document hanger as it is being attached to a rail.

In FIG. 4, the position of tabs 25 as hanger 16 is connected with rail 15 is illustrated. Initially, the V-shaped notch at the top of slit 20 receives rail 15. As hanger 16 is rotated into engagement with rail 15, tabs 25 bend along rod 15 as illustrated. When tabs 25 become disposed along the side of rail 15, hanger 16 is moved upwardly. As rail 15 contacts the bottom of aperture 18, hanger 16 is moved forward forcing tabs 25 over the top of rail 15. When hanger 16 is sufficiently forward as permitted by the lengths of apertures 17*a* and 17*b*, tabs 25 snap down behind rail 15 enclosing rail 15 within aperature 18.

Figure 5:
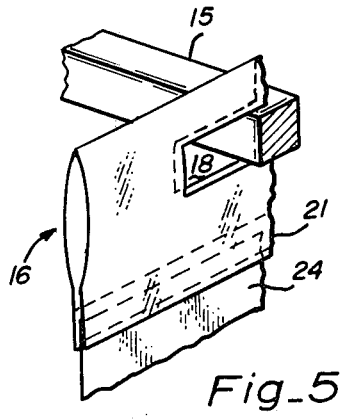
FIG. 5 is a perspective view illustrating the bowing of the folded document hanger caused by the spring-like nature of the materials used.

FIG. 5 illustrates the bowed sides of hanger 16 caused by the resilient nature of the material used. Folding the elongated strip and attaching the folded sides together along the edge opposite the fold forms a natural bow in the sides which separates the bearing edges and gives structural rigidity to the hanger. Material used should be of relatively tear-resistant plastic or other flexible material which is rigid enough to hold its shape while supporting documents of a particular weight. Since in many cases the hanger may be applied to a single original or transparent or translucent document from which prints are to be made by passing it through a print-making machine, the material should be thin so that it will pass through the machine with the document and need not be removed each time a print is to be made. Moreover, the material should be of a resilient and tear-resistant plastic or other flexible material which is rigid enough to hold its shape and flex back to it while supporting documents.

It should be noted that the document is enclosed within the sides of hanger 16 and is thereby protected from the tendency of the corners to roll, tear or pull away from the adhesive.

Figure 6:
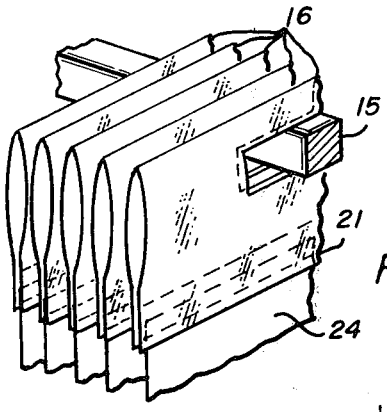
FIG. 6 is a perspective view showing several document hangers, the central hangers having reduced bowing and the outside hangers having normal bowing.

Referring to FIG. 6, the reduction in bowing of the inner hangers allowing more documents to be hung is illustrated. The outer document hangers remain naturally bowed giving lateral support to the inner hangers.

The illustrated hanger 16 may be used in association with rails separated by either of two spacings X. The first and most preferred spacing is shown in FIGS. 2 and 3. As illustrated, the rails 14 and 15 have a width R and a center-to-center spacing $X_1$. The hanger tabs 22 and 25 have a width (in the longitudinal direction of strip 16) of T, and slits 19 and 20 have a width of S. In order for this embodiment of the device to work in its intended manner, the longitudinal length A of aperture 17 must be long enough so that with rail 14 in the rightmost portion of aperture 17, rail 15 may be inserted through slit 20 and into the position shown in FIG. 3. In order to accomplish this the length A of aperture 17 must be at least equal to $R + T + S$. Accordingly, it may be shown that the center-to-center spacing $D_1$ between the centers of apertures 17 and 18 (where the lengths of apertures 17 and 18 are equal) must be equal to $X_1 + T + S$. It should be noted that $D_1$ is also the spacing between the tab side edges of apertures 17 and 18. For clarity, this is shown as $D_1'$ in FIG. 3.

It is the intent of the present invention to make both aperture 17 and 18 identical in size and configuration since the additional clearance outside each rail will permit hanger 16 to be skewed relative to the rails. Although not absolutely necessary to facilitate the intended document hanging function, this feature provides ease of movement along the rails and permits skewing of the documents for inspection. It should be understood, however, that if desired, the length of aperture 18 could be reduced to a length only slightly larger than R, since rail 15 does not move into the leftmost portion except when the hanger is skewed.

Figure 7:
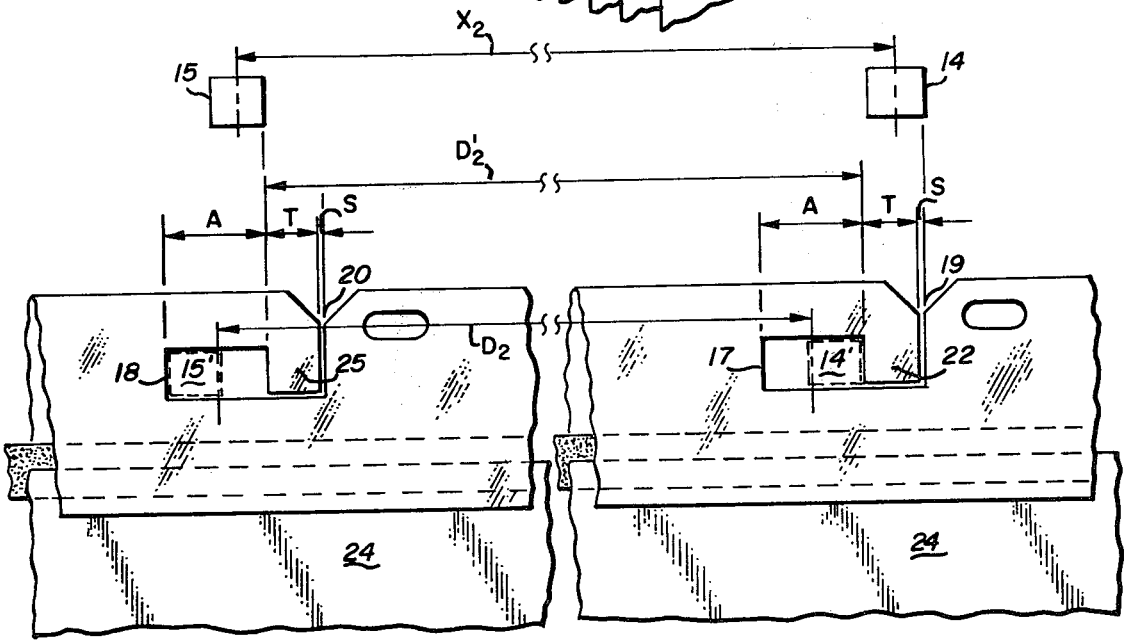
FIG. 7 is a fragmentary view illustrating the dimensions used in the formula for determining the relative distances between, and measurements of, the parts of the document hanger.

In FIG. 7, an alternative spacing of the rails is illustrated. In this embodiment the rails 14 and 15 likewise have a width R, but have a center-to-center spacing $X_2$. The tabs 22 and 25 have a width (in the longitudinal direction of strip 16) of T, and slits 19 and 20 have a width of S. For use with this rail configuration, the longitudinal length A of aperture 18 must be long enough so that rail 15 may first be inserted through slit 20 and into position adjacent tabs 25, and then be moved into the position shown by the dashed lines 15' as rail 14 is moved through slit 19 into the position shown by the dashed lines 14'. In order to accomplish this, the length A of aperture 18 must be at least equal to $R + T + S$. As in the previously described embodiment, it may be shown that the center-to-center spacing $D_2$ between the centers of apertures 17 and 18 (where the length of the apertures are the same) must be equal to $X_2 - T - S$. $D_2'$ is also the spacing between the tab side edges of apertures 17 and 18. The principal disadvantage of this embodiment is that no clearance is provided to allow skewing of the hangers for inspection or ease of lateral movement. For this reason the first described rail spacing is preferred.

Figure 8:
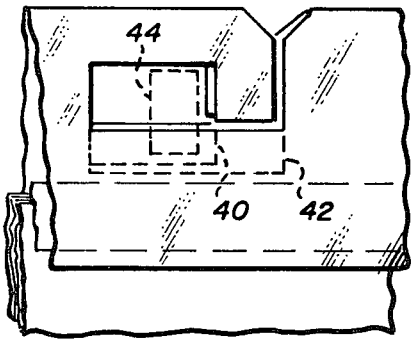
FIGS. 8–11 are perspective views of segments of document hangers illustrating possible alternative hanging aperture configurations.

It should be understood that the two alternative rail spacings may be used with the same hanging strip, and it is the intent of the present invention to make both aperture 17 and aperture 18 identical in size and configuration. However, if desired, for hanging strips intended to be used only for the FIG. 3 rail spacings, the length of aperture 18 could be reduced to slightly larger than R since rail 15 is not necessarily required to move into the leftmost portion thereof as rail 14 is positioned in aperture 17. Similarly, for strips intended for use only with rail spacings as shown in FIG. 7, the length of aperture 17 could be shortened. It should of course also be understood that the depth of the aperture 18 can be varied as illustrated by the dashed lines 40 and 42 in FIG. 8 to accommodate rails of rectangular or other configuration, such as suggested by the dashed lines 44.

Alternative embodiments may also incorporate apertures 13 shown in FIGS. 1, 2 and 3 to make the document hangers of this invention compatible with other document hanging systems.

Figure 9:
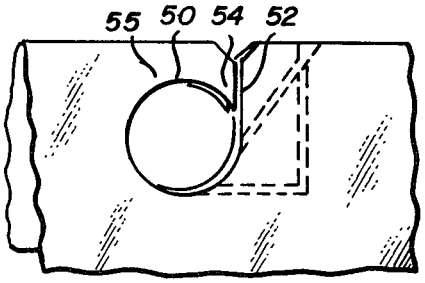
Figure 10:
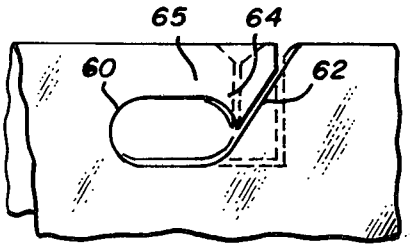
Figure 11:
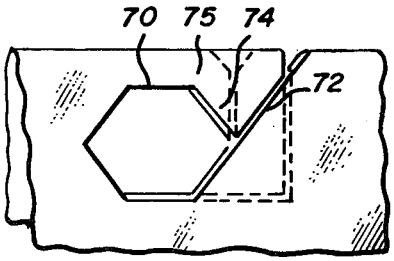

It will further be understood that apertures having configurations other than the above referred-to rectangular configurations may also be used in accordance with the present invention. For example, in the embodiments the apertures may be round, oval, oblong, or polygon shaped as respectively illustrated at 50, 60 and 70 in FIGS. 9, 10 and 11. Note also that by making the respective slits 52, 62 and 72 tangent to the apertures, i.e., so as to intersect a side portion of the apertures as illustrated, tabs 54, 64 and 74 are provided which cause the hanger to be positioned relative to the supporting rails such that the supporting forces (of rail on hanger) exerted on the support portions 55, 65 and 75 are not concentrated so close to the slits that the hanger becomes disengaged and falls from the rails. Various other slit positions which are tangent to the apertures are illustrated by dashed lines.

Figure 12:
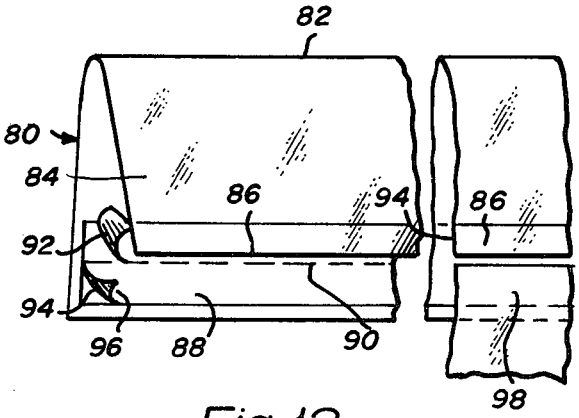
FIG. 12 is a perspective view of an end segment of a modified document hanger embodiment in accordance with the present invention.

In FIG. 12 an alternative configuration of the hanger is illustrated at 80 wherein the fold line 82 is not coextensive with the centerline of the strip. In this embodiment one side 84 of the folded strip is purposely made narrower than the other so that a portion 86 of this side may be adhesively fastened to the other side by a portion of the adhesive strip 88. As illustrated, the adhesive strip 88 is perforated along the line 90 so that the upper half 92 of the protective waxed paper may be removed and used to affix the edge portion 86 as indicated at 94 before a document is affixed thereto. Thereafter the lower portion 96 of the waxed paper may be removed so that the underlying portion of the adhesive strip may be used to affix a document to the hanger as indicated at 98.

Although the present invention has been described above with reference to certain preferred embodiments, it is to be understood that other alterations and modifications thereof may be made. It is therefore intended that the appended claims be interpreted to cover all such alterations and modifications as fall within the true spirit and scope of the invention.

What is claimed is:

1. Document hanging apparatus, comprising:

an elongated strip of flexible material having a foldline extending along its length and at least two pairs of apertures provided therein, the apertures of each pair being symmetrically disposed about said foldline, said strip also having a slit proximate each of said pairs of apertures and extending from a side portion of one of the apertures of the pair to the corresponding side portion of the other aperture of the pair, said strip being folded along said foldline to form a document receiving slot; and means for fastening a document to said strip.

2. Document hanging apparatus as recited in claim 1 wherein said slits include segments which tangentially intersect said apertures so that the folded portions of said strip lying between the apertures of each said pair form support members terminating in tab-like projections.

3. Document hanging aparatus as recited in claim 2 wherein said apertures are round in configuration.

4. Document hanging apparatus as recited in claim 2 wherein said apertures are oblong in configuration.

5. Document having appartus as recited in claim 2 wherein said apertures are polygon shaped in configuration.

6. Document hanging apparatus as recited in claim 2 wherein said slits extend from intersections with remote sides of said apertures in a direction generally parallel to said foldline and then turn at substantially right angles to intersect said foldline.

7. Document hanging apparatus as recited in claim 2 wherein said apertures are round in configuration and said slits extend from intersections with remote sides of said apertures in a direction generally parallel to said foldline and then turn at substantially right angles to intersect said foldline.

8. Document having apparatus as recited in claim 1 wherein the width of that portion of said strip on one side of said foldline is greater than the width of the portion on the other side of said foldline and wherein said means for fastening includes a strip of double-sided adhesive tape affixed to said one side of said strip in a position so that a portion thereof may be used to fasten the side edge portion of the other side to said one side and to leave a portion thereof exposed for fastening a document to said strip.

9. Document hanging apparatus, comprising:

an elongated strip of flexible material having a foldline and at least two pairs of apertures provided therein, the apertures of each pair being symmetrically disposed about said foldline, said strip also having a slit proximate each of said pairs of apertures running between the two sides of said apertures farthest separated, said strip being folded along said foldline to form a document receiving slot; and means for fastening a document to said strip.

10. Document hanging apparatus as recited in claim 9 wherein said slits extend from said remote side of said apertures in a direction generally parallel to said foldline and then turn at substantially right angles to intersect said foldline, said slits, said foldline and said apertures forming generally L-shaped portions terminating in tab-like projections.

11. Document hanging apparatus as recited in claim 10 wherein said hanging apparatus is adapted to mate with a document storage means having parallel supporting rails of width R and center-to-center spacing X, and wherein said tab-like projections have a longitudinal width T, said slits have a longitudinal width S and the spacing D' between the tab side edges of respective pairs of said apertures is equal to $X + T + S$.

12. Document hanging apparatus as recited in claim 11 wherein the longitudinal length of at least one of said apertures is $R + T + S$.

13. Document hanging apparatus as recited in claim 10 wherein said hanging apparatus is adapted to mate with a document storage means having parallel supporting rails of width R and center-to-center spacing X, and wherein said tab-like projections have a longitudinal width T, said slits have a longitudinal width S and the spacing D between the tab side edges of respective pairs of said apertures is equal to $X - T - S$.

14. Document hanging apparatus as recited in claim 13 wherein the longitudinal length of at least one of said apertures is $R + T + S$.

15. Document hanging apparatus as recited in claim 9 wherein said means for fastening includes at least one strip of adhesive affixed to at least one surface of said strip within said slot.

* * * * *